US005810332A

United States Patent [19]

Vestergaard et al.

[11] Patent Number: 5,810,332

[45] Date of Patent: Sep. 22, 1998

[54] VALVE, IN PARTICULAR EXPANSION VALVE FOR REFRIGERATION SYSTEMS, AND A METHOD FOR THE MANUFACTURE THEREOF

[75] Inventors: Anders Vestergaard, Sydals; Jens Jørn Hansen; Henrik Thomas Denning, both of Nordborg, all of Denmark

[73] Assignee: Danfoss A/S, Nordborg, Denmark

[21] Appl. No.: 596,256

[22] PCT Filed: Aug. 22, 1994

[86] PCT No.: PCT/DK94/00314

§ 371 Date: Feb. 7, 1996

§ 102(e) Date: Feb. 7, 1996

[87] PCT Pub. No.: WO95/05908

PCT Pub. Date: Mar. 2, 1995

[30] Foreign Application Priority Data

Aug. 23, 1993 [DE] Germany ..... 43 28 315.2

[51] Int. Cl.[6] ..... F16K 51/00

[52] U.S. Cl. ..... 251/368; 251/356

[58] Field of Search ..... 251/368, 356

[56] References Cited

U.S. PATENT DOCUMENTS

| | | | |
|---|---|---|---|
| 4,357,807 | 11/1982 | Aleksandrow | 62/228 |
| 4,633,681 | 1/1987 | Webber | 137/513.5 |
| 4,951,920 | 8/1990 | Tsuno | 251/356 |

*Primary Examiner*—A. Michael Chambers
*Attorney, Agent, or Firm*—Lee, Mann, Smith, McWilliams, Sweeney & Ohlson

[57] ABSTRACT

In a valve, in particular an expansion valve for refrigeration systems, at least the housing (2) and all nozzles (3, 4, 5) are deep-drawn parts of stainless steel having a carbon content of less than 0.05%. These parts are joined to one another by soldering. The steel has such a low content of carbon that despite being subjected to the effects of heat during soldering, it is practically insensitive to intercrystalline corrosion. This produces a visually attractive valve that is not harmful to the environment.

14 Claims, 1 Drawing Sheet

VALVE, IN PARTICULAR EXPANSION VALVE FOR REFRIGERATION SYSTEMS, AND A METHOD FOR THE MANUFACTURE THEREOF

BACKGROUND OF THE INVENTION

The invention relates to a valve, in particular to an expansion valve for refrigeration systems, having a housing and at least one nozzle which are joined to one another by soldering; the invention also relates to a method for the manufacture of the valve.

Commercially available expansion valves have a housing of brass into which, in some cases, nozzles of copper are soldered. Brass housings of that kind become discoloured at the surface as a consequence of the so-called "patina". This phenomenon is undesirable in the food industry and in other applications. In addition, the visual impression suffers. For that reason, it is known to provide the surface with a layer of nickel. But this is said to lead to health problems, namely to nickel allergy, which is very widespread. In addition, a careful watch is kept on heavy metals in the natural-food chain, as nickel salts are suspected of causing cancer.

The invention is based on the problem of providing a valve of the kind described in the introduction which is better suited to practical applications.

SUMMARY OF THE INVENTION

This problem is solved according to the invention in that at least the housing and all nozzles are deep-drawn parts of stainless steel which has such a low carbon content that despite being subjected to the effects of heat during soldering it is practically insensitive to intercrystalline corrosion.

Stainless steel, as defined in DIN 17441, contains at least 12% chromium. Stainless steel does not tend to discolour. It is not harmful to the environment, neither does it give rise to health problems. It is, however, necessary to use a steel with a very low carbon content, because otherwise the heat treatment associated with the soldering process causes sensitisation to so-called intercrystalline corrosion (for example, through separating out of chromium carbide), which occurs in moist environments or environments containing water vapour and which ultimately affects the strength and seal of the valve.

If a low proportion of carbon is chosen, however, machining of the steel becomes more difficult and more expensive compared with steels containing larger proportions of carbon. Housings and nozzles are therefore in the form of deep-drawn parts. A valve (expansion valve, magnetic valve, check valve and so on) which is highly suitable not only for refrigeration systems but also for the food industry and for similar conditions of use is therefore produced.

The stainless steel may, in particular, contain chromium and nickel, and in particular be a chromium-nickel-molybdenum steel. Nickel improves the deep-drawing and soldering properties. Molybdenum counteracts corrosion associated with splitting and corrosion associated with stress.

The chromium carbides mentioned above are formed at temperatures between 500° and 900° C., the fastest rate of separating-out lying between 600° and 700° C. How long it is admissible to operate in these ranges depends on the carbon content of the steel. It is especially recommended for the stainless steel to contain less than 0.05% of carbon. A soldering time of 6 to 7 minutes is then admissible, which is a typical period for a soldering process between 600° and 700° C. If, however, soldering takes place at higher temperatures and if the critical temperature range is passed through more rapidly during cooling, then somewhat higher proportions of carbon, such as 0.055 or 0.06%, are also acceptable.

All in all, a stainless steel having almost the following composition is recommended: C≦0.06%; Cr=12 to 22%; Ni=6 to 18%; Mo=0 to 6%; rest =Fe. To this may be added elements such as P, S, Si and/or Mn, in the usual small quantities.

In most cases it is preferable if the stainless steel contains less than 0.05% C.

The best results have been achieved with stainless steel having the following composition: C<0.06%; Cr =16 to 20%; Ni=8 to 15%; Mo=0 to 4%, rest =Fe.

It is advisable for the nozzle to have a flange that is soldered onto the outer surface of the housing. The flanges provide a large area of contact with the housing and allow secure fixing even in the case of thin-walled nozzles, as produced in deep-drawing.

Furthermore, it is possible for the housing to have an external flange at its front end to which the base ring of a diaphragm chamber, likewise formed without machining, is soldered or fixed through laser welding. In addition to the nozzles, other parts formed without machining can therefore also be mounted on the housing.

It is advisable to use a copper-containing alloy as solder and in particular a silver-containing solder known per se. Customary soldering methods can therefore be used.

In a preferred embodiment, at least some deep-drawn parts carry a copper layer. This improves the soldering behaviour.

It is also advantageous for the nozzles to have on their inside a copper layer extending as far as the free end. Such a copper layer provides a sealed and strong join, in particular when the join is to a copper pipe. Comparatively small layer thicknesses of the order of 10 to 100 $\mu$m are sufficient.

A method for the manufacture of a valve is characterised in that at least the housing and the nozzle, of which there is at least one, are deep-drawn from flat blanks of stainless, low-carbon steel and are subsequently soldered to one another. In mass production, the manufacture of the deep-drawn parts from such blanks is an especially inexpensive method of production.

It is then advisable for blanks coated on one side with copper to be used, at least for manufacturing the nozzles. The particular nozzle is then coated throughout with a copper layer.

BRIEF DESCRIPTION OF THE DRAWINGS

The invention is explained in greater detail hereinafter with reference to a preferred embodiment illustrated in the drawing, in which.

DESCRIPTION OF AN EXAMPLE EMBODYING THE BEST MODE OF THE INVENTION

Figure 1:
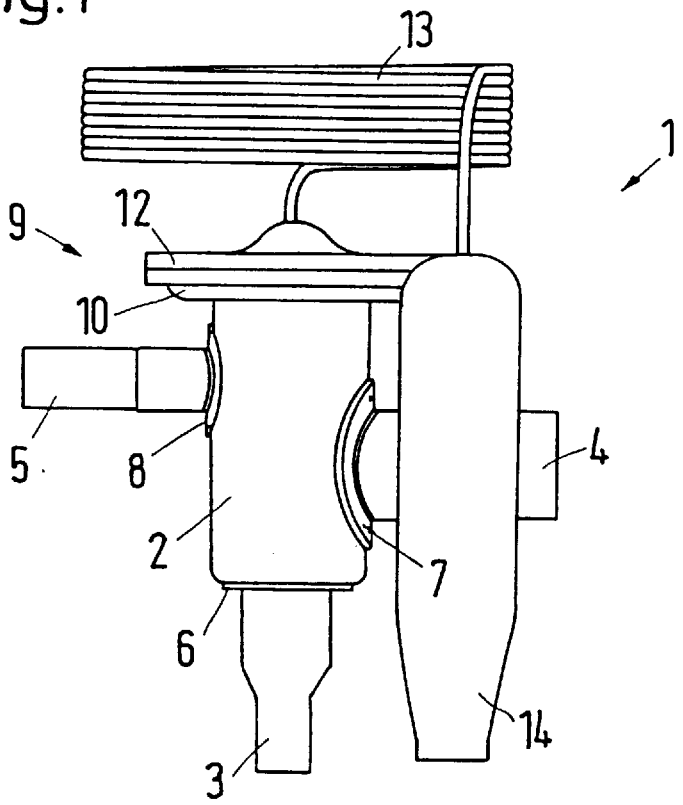
FIG. 1 shows the side view of a valve according to the invention.

The valve 1 illustrated is an expansion valve for a refrigeration system. It comprises a housing 2 with three nozzles, namely a nozzle 3 for the incoming liquid coolant, a nozzle 4 for the outgoing coolant in vapour form, and a nozzle 5 for connection to a sensor line. All the nozzles have an external flange 6, 7 and 8, with which they are soldered to the outside of the housing to form a large-area seal. One end of the housing 2 is closed by a diaphragm chamber 9, the base ring 10 of which is soldered to an external flange 11 of the housing 2. A cover plate 12 of the diaphragm chamber is connected by way of a capillary tube 13 to a sensor 14. The diaphragm 15 is therefore pressurised from above by the pressure owing to evaporation of the fluid in the sensor 14 and is pressurised from below by the pressure of the refrigerant, which is detected at the nozzle 5, and by a spring, not illustrated.

All the parts of the valve 1 shown in FIG. 1 consist of stainless steel with such a small content of carbon that there are virtually no deposits present on the finished valve which could later lead to intercrystalline corrosion. Here, the housing 2 and nozzles 3, 4 and 5 are in the form of deep-drawn parts, whilst the base ring 10 and the cover 12 are stamped parts. For example, a steel with the material number 1.4404 (DIN 17440—short name X2CrNiMo1810; DIN 17441 —short name X2CrNiMo17132) is used, the nickel content of which improves the deep-drawing and soldering properties and the low carbon content of which in combination with the molybdenum proportion counteracts corrosion associated with splitting and corrosion associated with stress. Such a stainless steel is known to be acid- and sea-water-resistant. It has the following composition: C≦0.03%; Cr=16.5 to 18.5%; Ni=11.0 to 14.0%; Mo=2.0 to 2.5%; Si≦1.0%; Mn ≦2.0%, P≦0.045%, S≦0.03%, rest Fe.

Another very suitable steel has the material number 1.4306, DIN 17441—short name X2CrNi1911, with the following composition: C≦0.03%; Cr=18 to 20%; Ni=10 to 12.5%, Si≦1.0%, Mn≦2.0%; P≦0.045%, S≦0.03%; rest Fe.

However, many more steel types can be used. It is important that the C-content is ≦0.06%, preferably ≦0.05%, in order that the soldering causes no intercrystalline corrosion, that the chromium content is higher than 12% to give the resistance to stain and acid, and that a sufficient content of nickel is provided to keep the material fit for deep-drawing.

Figure 2:
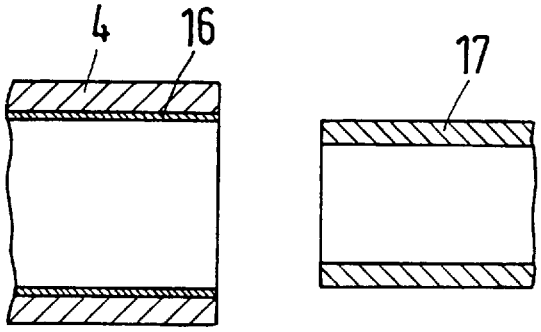
FIG. 2 shows the nozzle and copper pipe in the process of being joined together.
Figure 3:
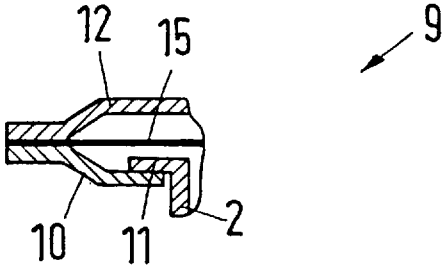
FIG. 3 shows a partial cross-section through the diaphragm chamber.

Using the example of the nozzle 4, FIG. 2 shows that the inside of the nozzle 16 is provided with a solder layer 16 of copper. The material of the solder layer had already been applied to the steel blank from which the nozzles 3, 4 and 5 were deep-drawn. The starting point can be a relatively thin blank, for example 0.75 mm thick, of copper-plated stainless steel having a copper layer thickness of 10 to 100 $\mu$m. The solder layer therefore extends from the free end of the nozzle to the side of the flanges 6, 7 and 8 to be joined by soldering. Soldering can be effected in a furnace at relatively high temperatures, for example at 1000° C.

If a copper pipe 17 is inserted into the nozzle 4 and is soldered there, the solder layer 16 facilitates this process. A customary solder can be used, for example a copper solder to which 15% silver has been added, marketed under the trade name Silfoss 15. This solder fuses at about 700° C. This temperature can be achieved without problems at the free end of the nozzle in question using a welding torch.

This temperature does not have any detrimental effect on the heat-sensitive parts of the valve because the low thermal conductivity of the nozzle and the housing prevents this. The diaphragm chamber 9, for example, provided with its filling, is extremely temperature-sensitive. Its limit temperature is only 100° C.

In the manufacture of such a valve, the deep-drawn housing 2 is joined by soldering to the base plate 10 and the three nozzles 3, 4 and 5. The parts to be built in are then introduced into the valve housing 2 and finally the diaphragm chamber 9 is completed by putting into position the diaphragm and the cover 12, which is connected to the sensor 14 by way of the capillary tube 13. The heat-sensitive filler is then introduced into the sensor system. The valve is then ready for use. It is joined to the connection pipes 17 on site by introducing the latter into the nozzles or pushing the nozzles onto the connection pipes, and finally soldering these together.

The parts to be built in can also be introduced from below into the housing 2. Only then is the nozzle 3 mounted on the housing 2. If the parts to be built in are heat-sensitive, fixing of the parts to be fitted last can also be effected by a welding process, e.g. laser welding, which is less thermally damaging than a soldering process.

We claim:

1. An expansion valve for refrigeration systems, having a housing and at least one nozzle which are joined to one another by soldering, and in which at least the housing and the nozzles are deep-drawn parts of stainless steel which has such a low carbon content less than or equal to about 0.06% that despite being subjected to the effects of heat during soldering, it is practically insensitive to intercrystalline corrosion.

2. An expansion valve according to claim 1, in which the stainless steel contains chromium and nickel.

3. An expansion valve according to claim 2, in which the stainless steel is a chromium-nickel-molybdenum steel.

4. An expansion valve according to claim 1, in which the stainless steel has approximately the following composition: C≦0.06%, Cr=12 to 22%, Ni=6 to 18%; Mo=0 to 6%, rest Fe.

5. An expansion valve according to claim 1, in which the stainless steel contains less than 0.05% of carbon.

6. Valve according to claim 1, in which the stainless steel has approximately the following composition: C≦0.06%; Cr=16 to 20%; Ni=8 to 15%; Mo=0 to 4%, rest Fe.

7. An expansion valve according to claim 1, in which the nozzles have a flange which is soldered to the outer surface of the housing.

8. An expansion valve according to claim 1, in which the housing has an external flange at its front end to which the base ring of a diaphragm chamber is soldered or laser-welded.

9. An expansion valve according to claim 1, in which the solder is a copper-containing alloy.

10. An expansion valve according to claim 1, in which the solder is a silver-containing alloy.

11. An expansion valve according to claim 1, in which at least some deep-drawn parts carry a copper layer.

12. An expansion valve according to claim 9, in which the nozzles have on their inside a copper layer extending as far as a free end thereof.

13. A method for the manufacture of an expansion valve according to claim 1, with a housing and at least one nozzle, which are joined to one another by soldering, in which at least the housing and the nozzle, of which there is at least one, are deep drawn from flat blanks of stainless, low-carbon steel, and are subsequently soldered to one another.

14. A method according to claim 13, in which blanks coated on one side with copper are used at least for manufacturing the nozzles.

* * * * *